US005823896A

United States Patent [19]

Pearsall

[11] Patent Number: 5,823,896

[45] Date of Patent: Oct. 20, 1998

[54] BASKETBALL DEVICE

[76] Inventor: William L. Pearsall, 1144 Smith Rd., Unit A, Temperance, Mich. 48182

[21] Appl. No.: 886,517

[22] Filed: Jul. 2, 1997

[51] Int. Cl.[6] ..... A63B 69/00

[52] U.S. Cl. ..... 473/448

[58] Field of Search ..... 473/448, 449, 473/486, 487, 488, 489, 100, 101

[56] References Cited

U.S. PATENT DOCUMENTS

| | | | |
|---|---|---|---|
| 1,904,826 | 4/1933 | Peoples | 473/448 |
| 3,160,414 | 12/1964 | Gray | 473/448 |
| 3,348,840 | 10/1967 | Dix | 473/449 |
| 4,213,606 | 7/1980 | Wilson | 493/448 |
| 4,805,903 | 2/1989 | McArdle | 473/489 |
| 4,836,539 | 6/1989 | Knapp | 473/433 |
| 4,877,241 | 10/1989 | Rothbard | 473/485 |
| 5,069,441 | 12/1991 | Fang | 493/485 |
| 5,207,789 | 5/1993 | Gates | 473/448 |
| 5,308,059 | 5/1994 | Owen, Jr. et al. | 473/448 |
| 5,364,092 | 11/1994 | Riepe et al. | 473/448 |
| 5,480,139 | 1/1996 | Owen, Jr. et al. | 473/486 |

*Primary Examiner*—William H. Grieb
*Attorney, Agent, or Firm*—MacMillan, Sobanski & Todd, LLC

[57] ABSTRACT

A basketball device for improving a player's shooting accuracy and concentration. The device comprises a removable rim that is placed over a regulation rim to decrease the inside diameter of the regulation rim. The device can easily be installed and removed from the regulation rim. By using the device having a smaller inside diameter, the device may also be used to handicap a player or team with a higher skill level than another player or team to facilitate competition between the two players or teams.

14 Claims, 2 Drawing Sheets

BASKETBALL DEVICE

BACKGROUND OF THE INVENTION

1. Field of the Invention

The invention relates in general to a basketball device, and in particular, to a basketball training device that easily attaches to a regulation size rim in order to decrease the diameter of the regulation rim.

2. Related Art

People try to improve their skill playing basketball using a wide varieties of training devices.

U.S. Pat. No. 4,213,606 to Wilson discloses a basketball training device mounted on a conventional basketball hoop. The training device comprises a support hoop having essentially the same diameter as the conventional hoop, and a secondary hoop which has a larger diameter than the conventional hoop and the support hoop. A portion of the secondary hoop projects upward and outwardly relative to the corresponding portion of the conventional hoop and the support hoop.

U.S. Pat. No. 5,069,441 to Fang discloses a basketball training assembly with an inner hoop, a middle hoop and an outer hoop. All three hoops are concentric and lie in the same plane. The shooting accuracy of the user may be improved by replacing the larger diameter hoops with the smallest diameter hoop.

U.S. Pat. No. 5,308,059 and 5,480,139 to Owen, Jr. et al. disclose a basketball hoop assembly comprises a first hoop of regulation size, and at least a second hoop having a smaller diameter and concentric with the first hoop. Each hoop is attached to the backboard with their own bracket. A user may increase their skills by practicing with hoops of smaller diameters than the first hoop until the user is proficient with the smallest hoop.

U.S. Pat. No. 5,207,789 to Gates discloses a basketball training device including a top portion with a downwardly extending inner edge and a downwardly extending outer edge. The inside diameter of the outer edge is slightly greater than the outside diameter of the regulation-sized rim. Also, the inside diameter of the inner edge is less than the inside diameter of the rim so that diameter of the regulation-sized rim is substantially reduced, preferably by more than two inches, when the device is installed on the rim. The device is attached to the rim using a plurality of fasteners having a threaded male member and a threaded female member. Each female member has a outwardly extending tab that engages beneath the rim to hold the rim between the tab and the bottom surface of top portion.

However, none of the above references provides a basketball device that is easy to install and remove. There is also a need to provide a basketball device that can be easily installed by anyone, even by children.

SUMMARY OF THE INVENTION

It is an object of the invention to provide a basketball device for improving the shooting accuracy of a player.

It is another object of the invention to provide a basketball training device that can be easily installed and removed.

It is yet another object of the invention to provide a basketball device that handicaps a more skilled player or team in order to facilitate competition between players or teams having different skill levels.

To achieve these and other objects, the basketball device comprises a substantially circular shaped member having a top portion and an inner edge extending downwardly from the top portion. The inner edge forms an inner diameter smaller than an inside diameter of a regulation rim of a basketball goal. To easily attach or remove the basketball device from the regulation rim, a plurality of clips removably attach the substantially circular shaped member to the regulation rim. Each clip includes a spring having an upwardly extending end portion for removably attaching the member to the regulation rim and a loop portion to position the end portion of the spring. Each clip also includes a threaded fastener, such as a flat-head bolt and the like, for removably attaching the spring to the substantially circular shaped member.

These and other aspects and advantages of the invention are described or apparent from the following detailed description of the preferred embodiments and appended drawings wherein like reference numbers refer to the same element, feature or component.

BRIEF DESCRIPTION OF THE DRAWINGS

The preferred embodiments are described with reference to the drawings in which.

DETAILED DESCRIPTION OF THE PREFERRED EMBODIMENTS

Figure 1:
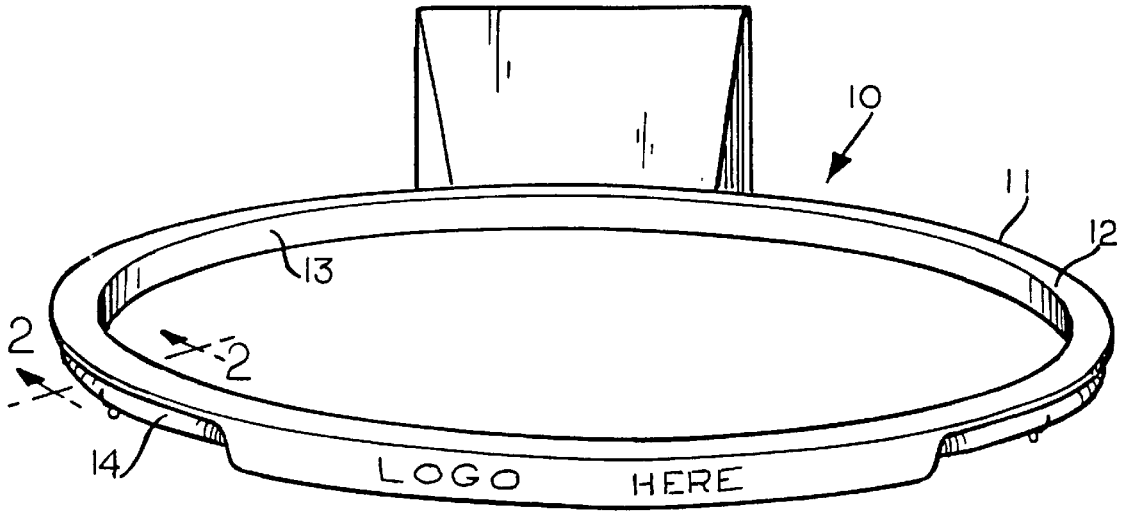
FIG. 1 is a perspective view of the device of the invention.

Referring now to the drawings, the basketball device 10 of the invention comprises a substantially circular shaped member 11 having a top portion 12 and an inner edge 13 extending downwardly from the top portion 12. The inner edge 13 forms an inner diameter smaller than an inside diameter of a regulation rim 14 of a basketball goal. The device 10 may be made of any suitable material, such as steel, a steel alloy, aluminum, a high-impact polymer composite, nylon, a metal/plastic composition, fiberglass, any extrudable material, and the like, so that it is both lightweight and durable. Further, the device 10 may comprise a fluorescent or highly visible color, such as orange, to further maintain and improve the player's concentration throughout the shot.

The top portion 12 preferably has a smooth, flat upper surface, and the corner where the top portion 12 is joined to the inner edge 13 is preferably smooth and rounded. The top portion 12 has a suitable thickness and width in order to withstand the impact of a basketball without sustaining damage. In the preferred embodiment, the top portion 12 has a thickness of approximately 0.125 inches and a width of approximately 0.50 inches.

As seen in FIGS. 1–4, the inside edge 13 has an inside diameter less than the inside diameter of the regulation rim 14. As a result, the opening through the basketball goal is substantially reduced. For example, the regulation rim typically has an inside diameter of approximately 18 inches. A regulation sized basketball has a circumference of 29.5 to 30 inches or a diameter of 9.55 inches. Therefore, the player has approximetely (18–9.55)/2=4.25 inches of clearance on either side of the basketball to make the goal without touching the basketball rim 14.

To reduce the amount of clearance, thereby making the goal more difficult to make, the basketball device 10 reduces the inside diameter of the regulation rim 14. Preferably, the inside diameter of the regulation rim 14 is reduced at least 0.5 inches using device 10. However, it should be appreciated that the invention is not limited by the amount that the inside diameter of the regulation rim 14 is reduced and that the invention may be practiced by reducing the inside diameter of the regulation rim 14 from approximately 0.5 to 4.25 inches. In other words, the invention may be practiced with the inside edge 13 reducing the inside diameter of the regulation rim 14 to an inside diameter in which the basketball may no longer fit into the basketball goal. By using device 10 having a smaller inside diameter to handicap a player or team with a higher skill level, the device 10 may be used to facilitate competition between the two players or teams having different skill levels.

To easily attach the device 10 to the regulation rim 14, the device 10 includes a plurality of clips 15. Preferably, four clips 15 are located approximately 90° from each other on member 11. Each clip 15 includes a spring 16 having a loop portion 17 and an upwardly extending end portion 18. When depressed, spring 16 has a sufficient amount of upward force to securely attach the device 10 to the regulation rim 14. It should be appreciated that the invention is not limited by the number of clips, and that the invention may be practiced with any number of clips to provide a sufficient amount of upward force to securely attach the device 10 to the regulation rim 14. Preferably, the upwardly extending end portion 18 has a radius of curvature approximately equal to the radius of curvature of the regulation rim 14. The radius of curvature can be readily determined as the regulation rim 14 typically has a diameter of ⅝ inches. It should be appreciated that clips 15 allow the device 10 to accommodate regulation rims of varying eccentricities and horizontal unevenness.

The spring 16 is removably attached to the member 11 by fitting the spring 16 around a sleeve or shaft 19. A threaded fastener 20, such as a flat-head bolt and the like, may be used to securely fasten the shaft 19 to the top portion 12 by screwing the threaded fastener 20 into the top portion 12 of the member 11. Preferably, threaded fastener 20 is flush with the bottom of the shaft 19 when screwed completely into the top portion 12.

Member 11 also includes a plurality of slots 21 for receiving the upwardly extending end portion 18. The slots 21 also provide the additional function of making the member 11 more lightweight than conventional training devices.

Member 11 may also include a front portion 22. The front portion 22 provides two functions. First, the front portion 22 is capable of displaying an advertisement or logo when positioned towards the players. Secondly, the front portion 22 provides a means for allowing the player of any age to raise the device 10 over the regulation rim 14 without the use of a ladder or similar device. This can be achieved by attaching a gripping tool (not shown) having a sufficient length to allow the player to stand on the ground while placing the device 10 over the regulation rim 14 to the front portion 22 of the device 10 and lifting the device 10 up and over the regulation rim 14.

Figure 2:
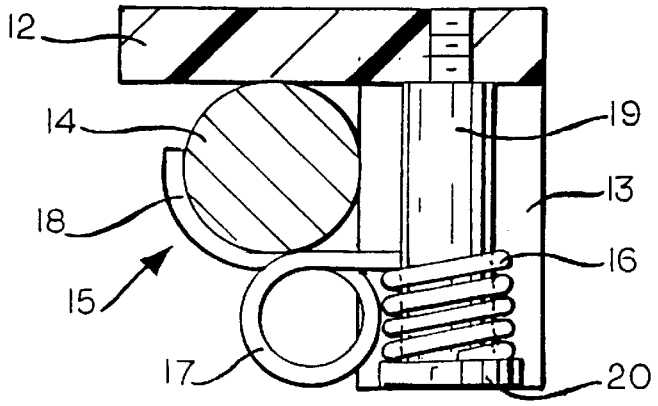
FIG. 2 is a sectional view taken along line 2—2 of FIG. 1.
Figure 3:
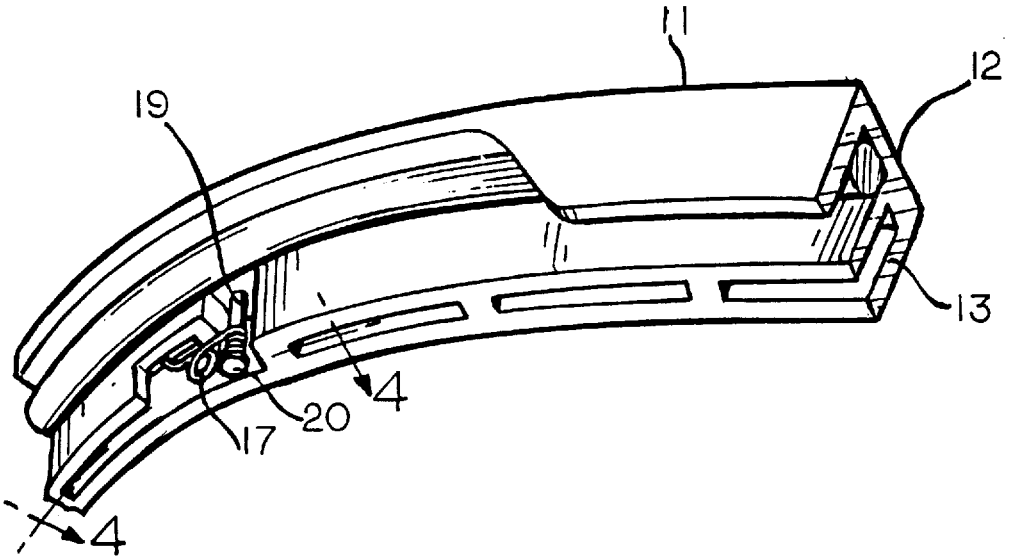
FIG. 3 is another perspective view of the device of the invention.
Figure 4:
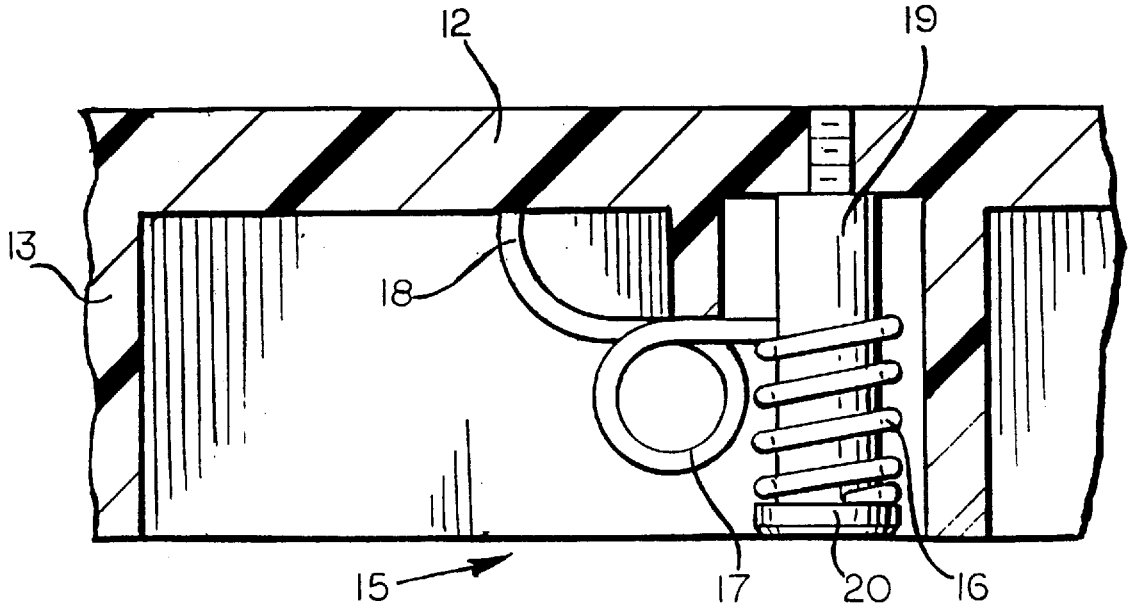
FIG. 4 is a sectional view taken along line 4—4 of FIG. 3.

Once the device 10 is placed over the regulation rim 14, the player hooks the loop portion 17 of the spring 15 using a tool (not shown) that can be inserted into the loop portion 17 of the spring 16. The player then pulls downward to depress the spring 16 and then turns the spring 16 such that the loop portion 17 is positioned underneath the regulation rim 14 and the end portion 18 of the spring 16 extends around the regulation rim 14, thereby removably attaching the basketball device 10 tightly against the regulation rim 14 as shown in FIG. 2.

The player may easily remove the device 10 by reversing the order of the installation procedure described above. The player simply turns the spring 16 using the tool (not shown) such that the loop portion 17 is no longer underneath the regulation rim 14 and the end portion 18 is no longer extending around the regulation rim 14. The end portion 18 may be positioned within a slot 21 adjacent the spring 16 for safe storage of the device 10. Next, the player simply lifts the device 10 off the regulation rim 14 using the gripping tool (not shown).

It should be appreciated that the basketball device can be quickly and easily installed and removed by any player while standing on the ground.

While this invention has been described in conjunction with specific embodiments, it is evident that many alternatives, modifications and variations will be apparent to those skilled in the art. Accordingly, the preferred embodiments of the invention as set forth herein are intended to be illustrative, rather than limiting. Various changes may be made without departing from the spirit and scope of the invention as defined in the following claims.

What is claimed is:

1. A basketball device, comprising:

a substantially circular shaped member having a top portion and an inner edge extending downwardly from the top portion, the inner edge forming an inner diameter smaller than an inside diameter of a regulation rim of a basketball goal; and a plurality of clips for removably attaching said member to the regulation rim, each clip including a spring having an upwardly extending end portion and a loop portion, wherein said member is removably attached to said regulation rim by positioning the loop portion of said spring underneath said regulation rim and by extending the end portion of said spring around said regulation rim.

2. The device according to claim 1, further comprising a threaded fastener for removably attaching said spring to said member.

3. The device according to claim 1, further comprising a front portion for enabling said member to be positioned over the regulation rim.

4. The device according to claim 1, wherein said plurality of clips comprises four clips.

5. The device according to claim 4, wherein each clip is positioned approximately 90° from each other.

6. A basketball device, comprising:

a substantially circular shaped member having a top portion and an inner edge extending downwardly from the top portion, the inner edge forming an inner diameter smaller than an inside diameter of a regulation rim of a basketball goal; and a plurality of springs removably attached to said member, each spring including an upwardly extending end portion and a loop portion, wherein said member is removably attached to said regulation rim by positioning the loop portion of said spring underneath said regulation rim and by extending the end portion of said spring around said regulation rim.

7. The device according to claim 6, wherein said plurality of springs comprises four springs.

8. The device according to claim 7, wherein each spring is positioned approximately 90° from each other.

9. The device according to claim 6, further comprising a threaded fastener for removably attaching said spring to said member.

10. The device according to claim 6, further comprising a front portion for enabling said member to be positioned over the regulation rim.

11. A basketball training device, comprising:

a substantially circular shaped member having a top portion and an inner edge extending downwardly from the top portion, the inner edge forming an inner diameter smaller than an inside diameter of a regulation rim of a basketball goal; and a plurality of spring-biased clips removably attached to said member, each clip including an upwardly extending end portion engaging a bottom portion of the regulation rim for securely attaching said member to the regulation rim, wherein said training device reduces the inside diameter of the regulation rim.

12. The training device according to claim 11, wherein each clip includes a loop portion for positioning underneath said regulation rim when securely attaching said member to the regulation rim.

13. The training device according to claim 11, wherein said member includes a plurality of slots for receiving the upwardly extending end portion when removing said member from the regulation rim.

14. The training device according to claim 11, wherein the inside diameter of the rim is reduced in a range from approximately 0.5 inches to approximately 4.25 inches.

* * * * *